US006296167B1

(12) United States Patent
Jen

(10) Patent No.: US 6,296,167 B1
(45) Date of Patent: Oct. 2, 2001

(54) NAIL CARTRIDGE FOR A PNEUMATIC NAIL DRIVING DEVICE

(75) Inventor: Huang Chien Jen, Taichung (TW)

(73) Assignee: Apach Industrial Co., Ltd. (TW)

( * ) Notice: Subject to any disclaimer, the term of this patent is extended or adjusted under 35 U.S.C. 154(b) by 0 days.

(21) Appl. No.: 09/827,275

(22) Filed: Apr. 5, 2001

(30) Foreign Application Priority Data

Dec. 21, 2000 (TW) ..... 089222238

(51) Int. Cl.[7] ..... B25C 1/04
(52) U.S. Cl. ..... 227/120; 227/136
(58) Field of Search ..... 227/120, 136, 227/119, 109

(56) References Cited

U.S. PATENT DOCUMENTS 5,297,713 * 3/1994 Perra et al. ..... 227/120
5,322,189 * 6/1994 Oda ..... 227/120
5,335,800 * 8/1994 Liu ..... 227/120
5,588,577 * 12/1996 Chen ..... 227/109
5,626,274 * 5/1997 Shkolnikov et al. ..... 227/136
6,056,181 * 5/2000 Chuang ..... 227/120
6,076,721 * 6/2000 Yang ..... 227/109
6,149,046 * 11/2000 Ho et al. ..... 227/120

* cited by examiner

*Primary Examiner*—Scott A. Smith
(74) *Attorney, Agent, or Firm*—Trop, Pruner & Hu, P.C.

(57) ABSTRACT

A nail cartridge for a pneumatic nail driving device includes a housing that defines therein a nail groove, a plate receiving space over the nail groove, a sliding passage disposed sidewisely and offset from the nail groove, and a gap between the plate receiving space and the nail groove. The nail cartridge further includes a nail pushing plate disposed movably in a longitudinal direction in the plate receiving space and extending into the nail groove, and an urging member for urging the nail pushing plate in a manner that the nail pushing plate is moved in a transverse direction relative to the longitudinal direction into the gap so as to clear the nail groove without requiring detachment of the nail pushing plate from the housing.

6 Claims, 8 Drawing Sheets

NAIL CARTRIDGE FOR A PNEUMATIC NAIL DRIVING DEVICE

BACKGROUND OF THE INVENTION

1. Field of the Invention

This invention relates to a nail cartridge for a pneumatic nail driving device, more particularly to a nail cartridge for a pneumatic nail driving device with a nail pushing plate that is capable of moving in a longitudinal direction and a transverse direction relative to the longitudinal direction.

2. Description of the Related Art

FIG. 1 illustrates a conventional pneumatic nail driving device 10 which includes an air gun body 11, a nail cartridge 20 connected to the air gun body 11 and adapted to receive nails 30 therein, and a guiding plate 12 facing and cooperating with an end face of the nail cartridge 20 to define a nail feeding passage therebetween so that the nails 30 in the nail cartridge 20 can be pneumatically driven through the nail feeding passage.

The nail cartridge 20 includes an elongated housing 21 extending in a longitudinal direction and defining therein a nail groove for receiving the nails 30, a plunger 22 disposed and movable in the longitudinal direction in the nail groove in the housing 21, and an urging member 222 for urging the plunger 22 to push the nails 30 in the nail groove to move toward the guiding plate 12.

The pneumatic nail driving device 10 is disadvantageous in that since the plunger 22 is disposed in the nail groove, refill of the nails 30 into the housing 21 requires detachment of the plunger 22 from the housing 21 for clearing the nail groove. The detachment and subsequent assembly of the plunger 22 is laborious and time-consuming.

SUMMARY OF THE INVENTION

Therefore, it is an object of the present invention to provide a nail cartridge for a pneumatic nail driving device that is capable of overcoming the aforesaid drawbacks.

According to the present invention, a nail cartridge for a pneumatic nail driving device comprises: an elongated cartridge housing that extends in a longitudinal direction, that has top and bottom ends, front and rear sides, and left and right open ends and that defines therein a nail groove extending in the longitudinal direction from the left open end to the right open end and extending upwardly from the bottom end of the housing and adapted to receive nails which are to be aligned in the longitudinal direction, a plate receiving space extending along the length of the nail groove and extending upwardly from the nail groove to the top end of the housing and having a front side, and a sliding passage disposed sidewisely at the front side of the plate receiving space and extending along the length of the plate receiving space, the housing including upper and lower partitions that have top and bottom ends, that are disposed between the plate receiving space and the sliding passage, that extend along the length of the sliding passage, and that are vertically registered with each other to define therebetween a gap so as to permit the sliding passage to be in spatial communication with the plate receiving space, the housing being formed with upper and lower recesses which are vertically registered with each other, which extend from the top ends of the upper and lower partitions through the bottom ends of the upper and lower partitions, and which are disposed adjacent to the right open end of the housing; a nail pushing plate disposed and movable in the longitudinal direction in the plate receiving space, spanning the upper and lower partitions, and having an upper portion received in the plate receiving space and a lower portion extending downwardly from the upper portion into the nail groove, the nail pushing plate being adapted to push the nails in the nail groove to move from the right open end to the left open end; a first urging member disposed in the sliding passage and having one end that is secured to the housing adjacent to the left open end of the housing, and an opposite end that is movable in the longitudinal direction in the sliding passage and that is connected to the nail pushing plate so as to urge the nail pushing plate to move from the right open end to the left open end of the housing; and a second urging member for urging the nail pushing plate in a manner that when the nail pushing plate is moved in the plate receiving space to a first position where the upper and lower portions of the nail pushing plate are laterally and respectively registered with the upper and lower recesses, the nail pushing plate will be moved frontwardly by the second urging member to a second position where the upper portion of the nail pushing plate is selectively received in one of the sliding passage and the gap and is retained therein, and where the lower portion of the nail pushing plate is sidewisely offset from the nail groove so as to permit the nail groove to be cleared of the nail pushing plate and to thereby permit loading of the nails into the nail groove from the right open end of the housing.

BRIEF DESCRIPTION OF THE DRAWINGS

In drawings which illustrate an embodiment of the invention.

DETAILED DESCRIPTION OF THE PREFERRED EMBODIMENT

Figure 1:
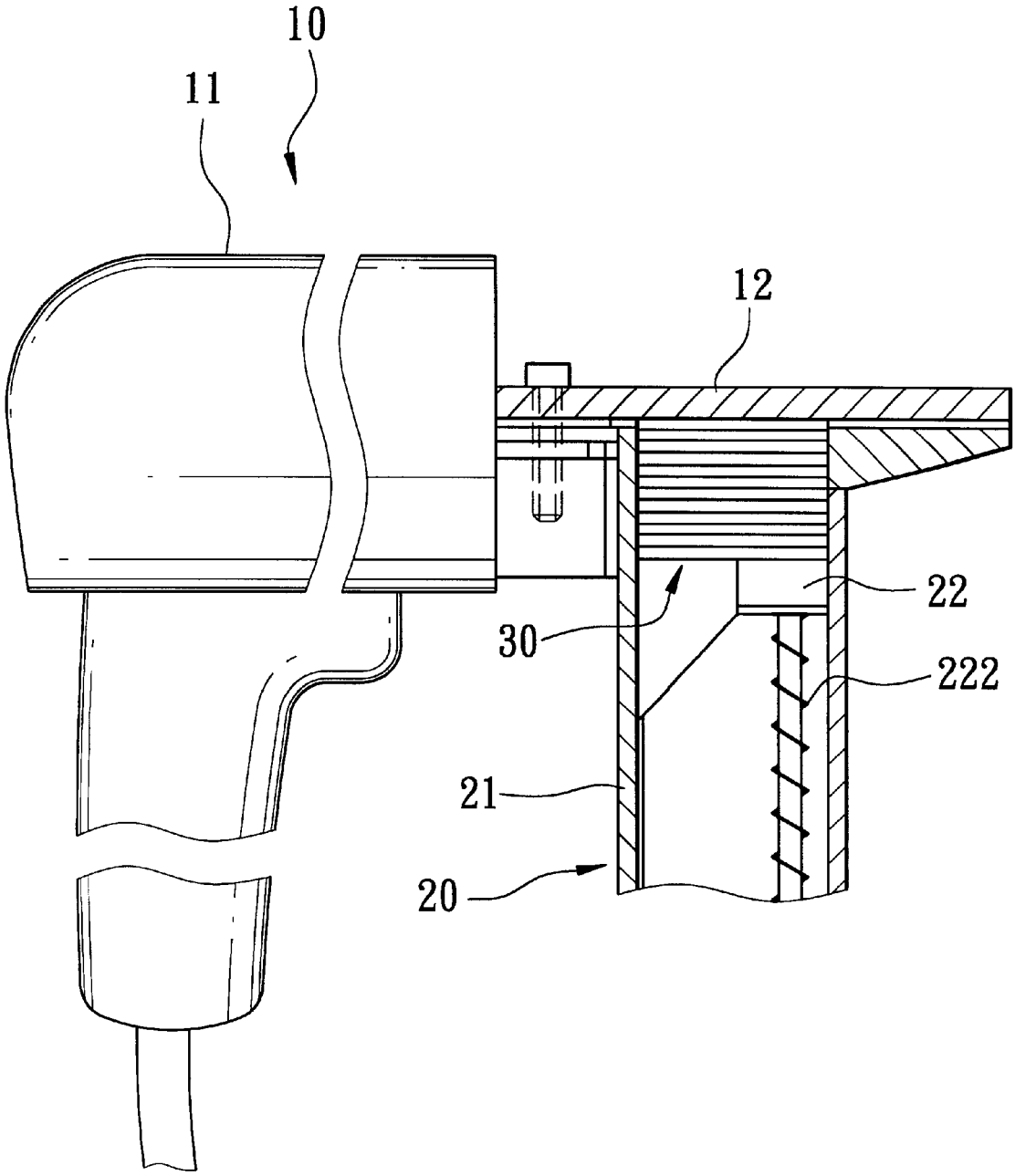
FIG. 1 PRIOR ART
FIG. 1 is a fragmentary partly sectional schematic view showing a conventional nail cartridge for a pneumatic nail driving device.
Figure 2:
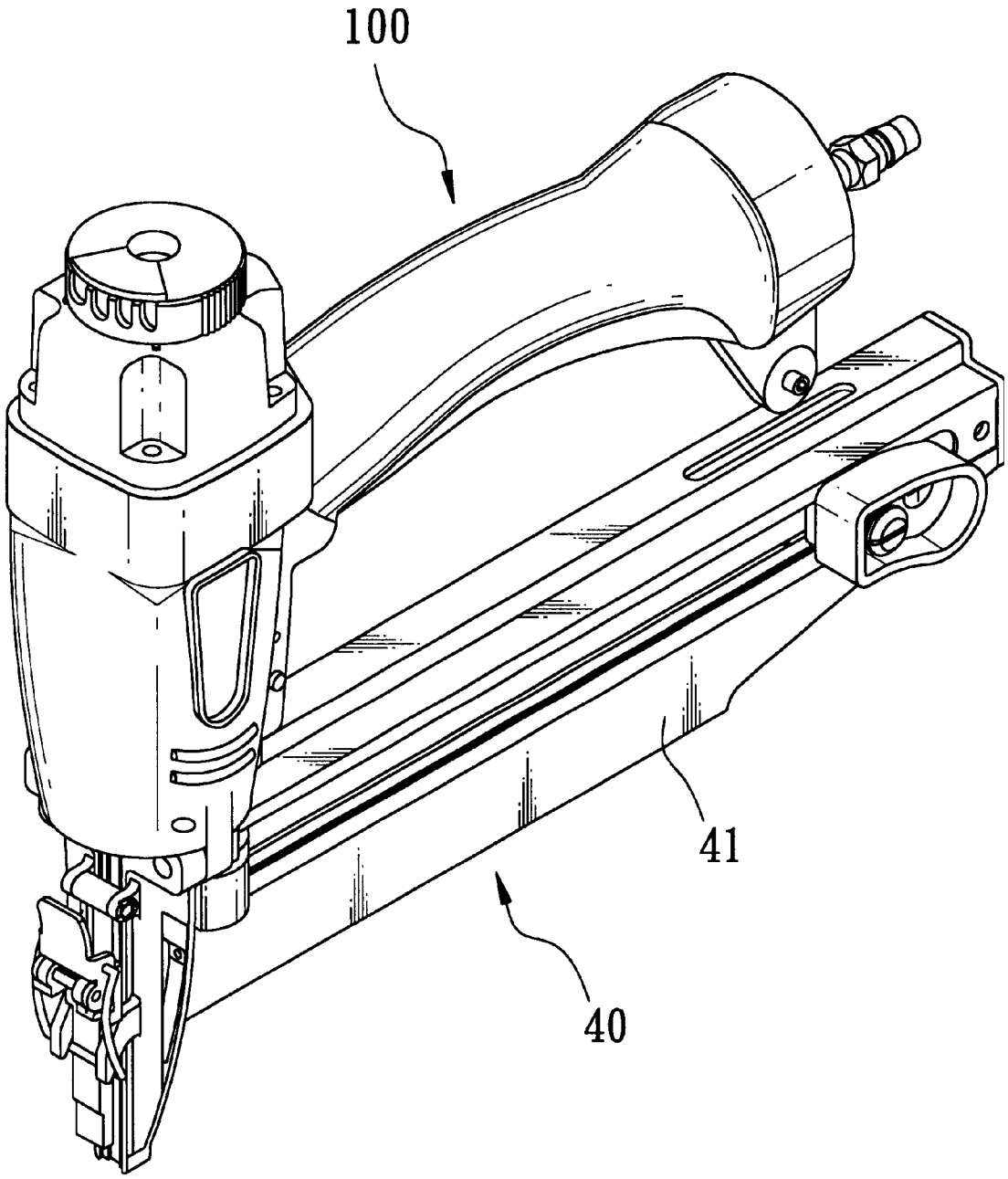
FIG. 2 is a perspective view showing a pneumatic nail driving device with a preferred embodiment of a nail cartridge according to this invention.
Figure 3:
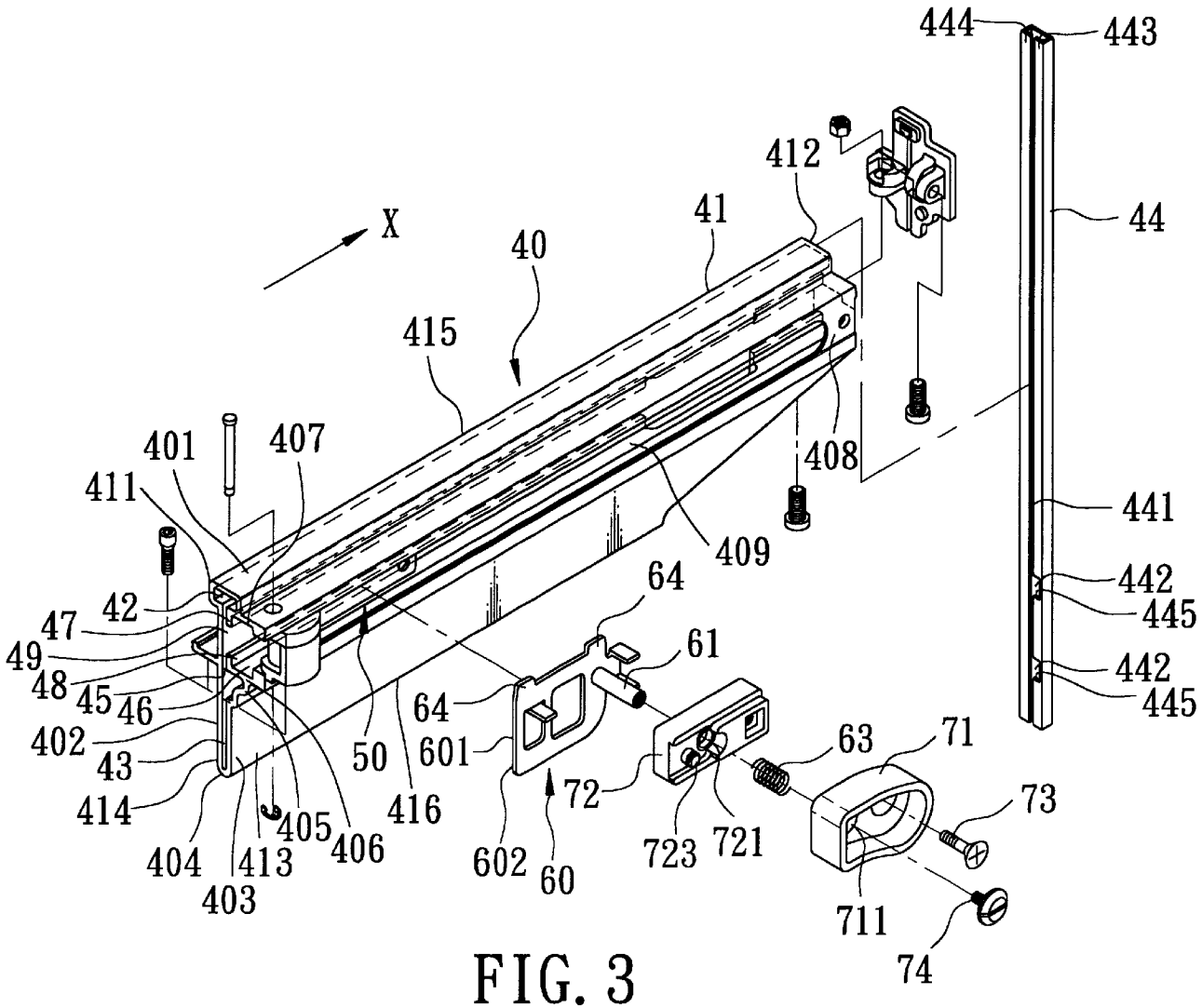
FIG. 3 is an exploded perspective view of the nail cartridge of FIG. 2.
Figure 4:
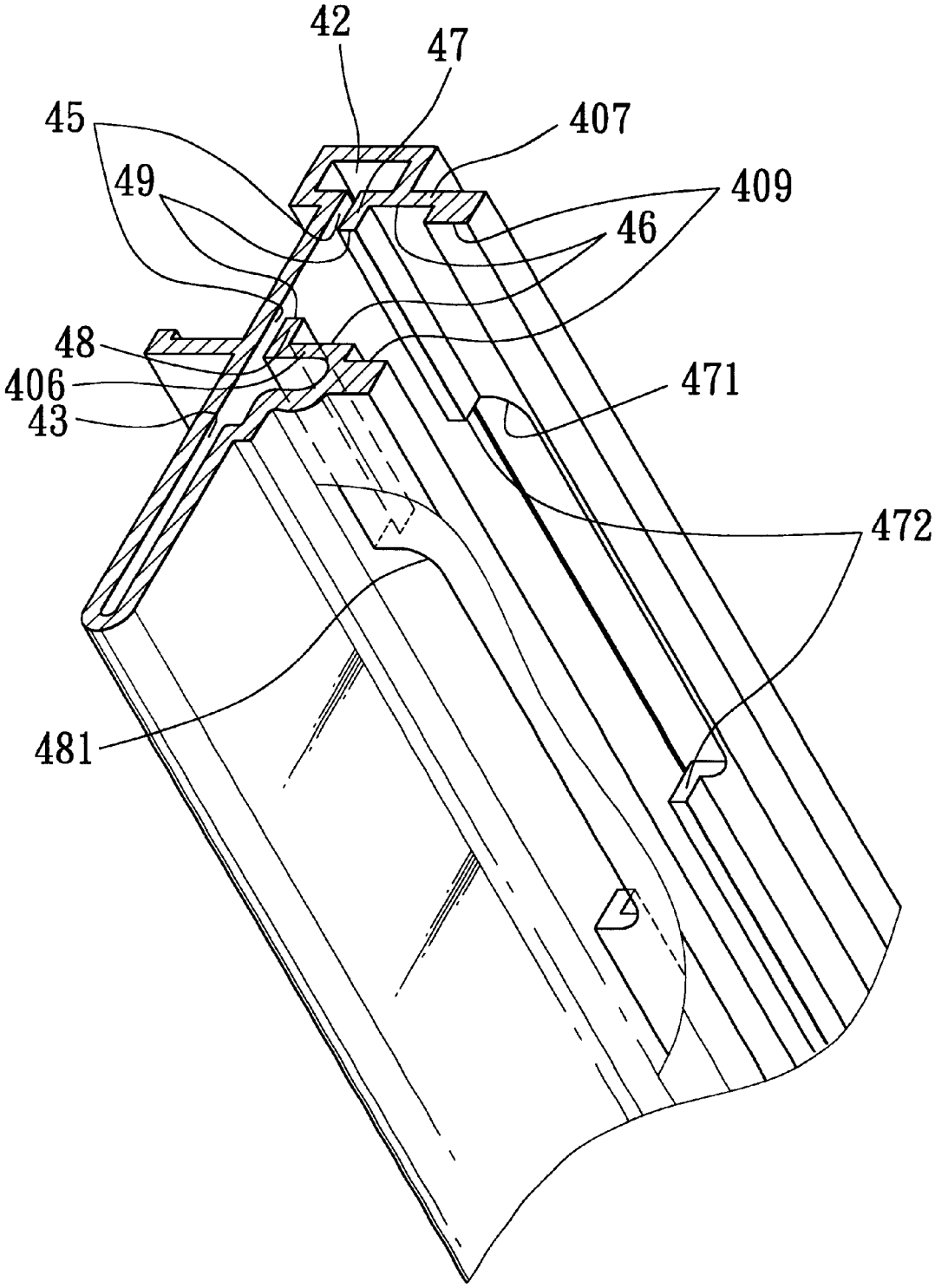
FIG. 4 is a perspective cutaway view to illustrate upper and lower recesses of upper and lower partitions of the nail cartridge of FIG. 2.
Figure 5:
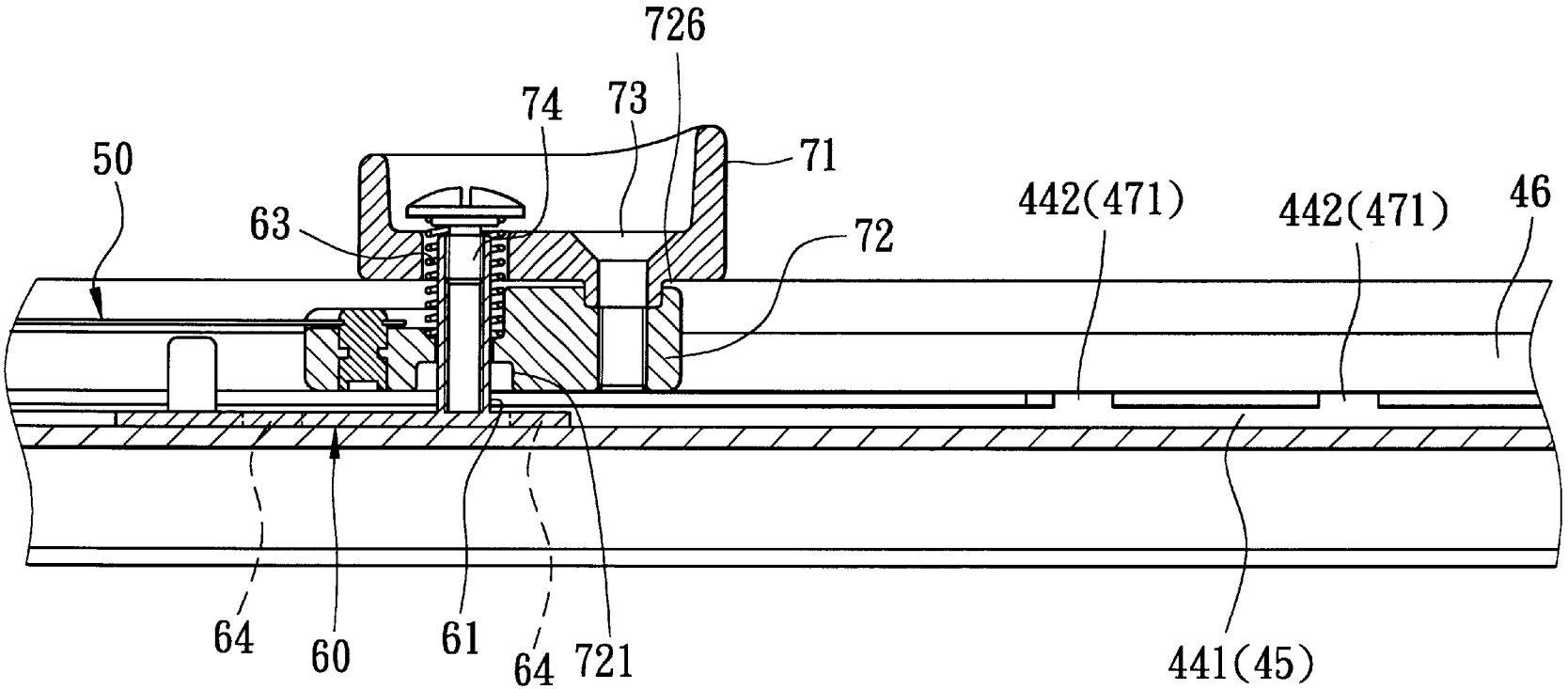
FIG. 5 is a fragmentary cross-sectional top view of the nail cartridge of FIG. 2, with an upper portion of a nail pushing plate of the nail cartridge disposed in a plate receiving space.
Figure 6:
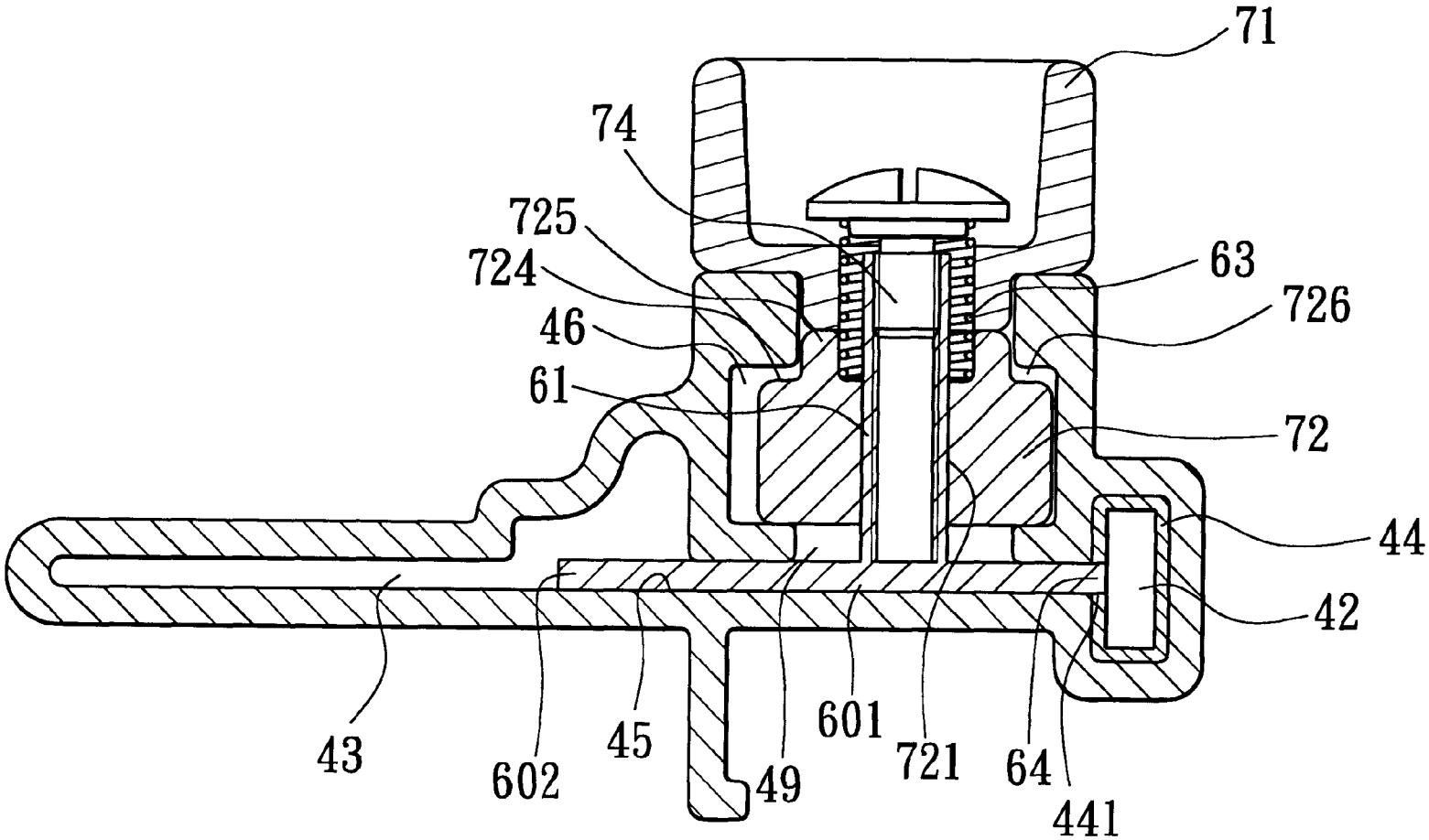
FIG. 6 is a cross-sectional side view of the nail cartridge of FIG. 2, with the upper portion of the nail pushing plate of the nail cartridge disposed in the plate receiving space.

FIGS. 3 to 6 illustrate a preferred embodiment of a nail cartridge 40 for a pneumatic nail driving device 100 of this invention. The nail cartridge 40 includes an elongated cartridge housing 41, an elongated hollow guide rail 44, a planar nail pushing plate 60, a sliding seat 72, a knob 71, a first urging member 50 in the form of a spiral spring, and a second urging member 63 in the form of a coil spring.

Figure 7:
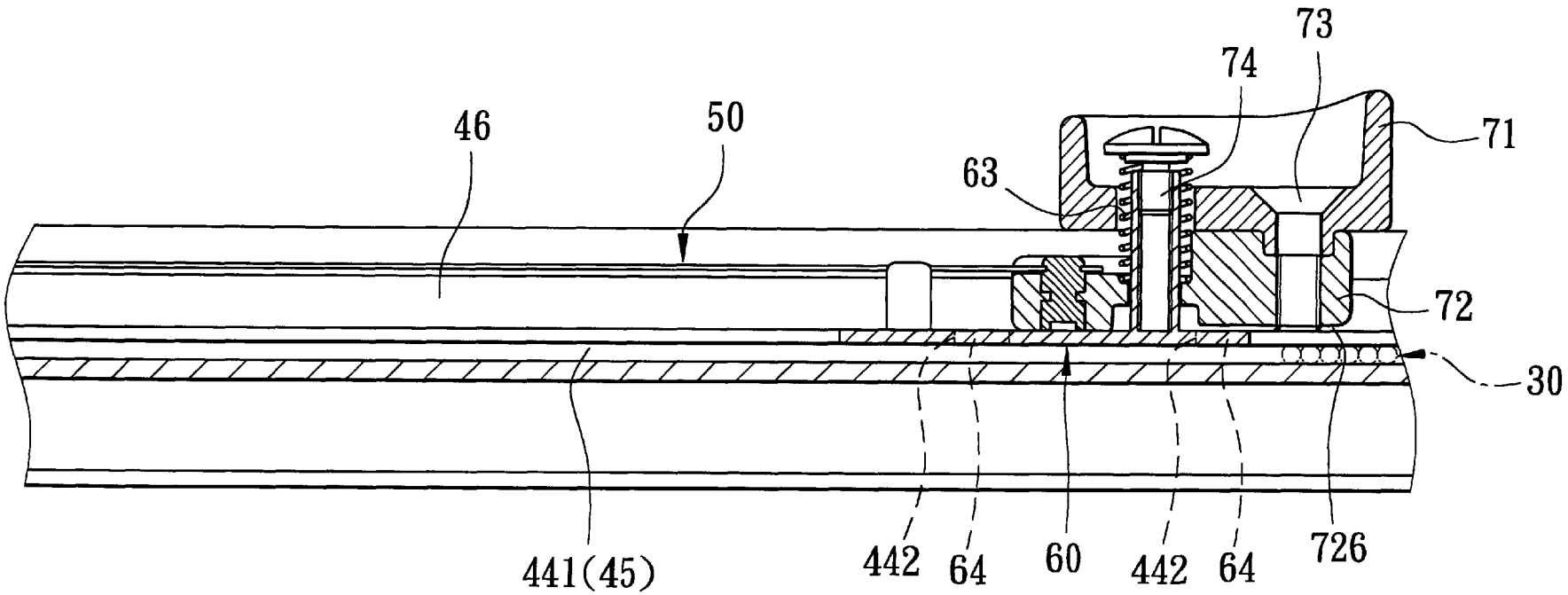
FIG. 7 is a fragmentary cross-sectional top view of the nail cartridge of FIG. 2, with the upper portion of the nail pushing plate of the nail cartridge disposed in the upper and lower recesses.

The cartridge housing 41 extends in a longitudinal direction (X), has left and right open ends 411, 412, front and rear sides 413, 414, and top and bottom ends 415, 416, and defines therein a nail groove 43 extending in the longitudinal direction (X) from the left open end 411 to the right open end 412 and extending upwardly from the bottom end 416 of the housing 41 and adapted to receive nails 30 (see FIG. 7) which are to be aligned in the longitudinal direction (X), a plate receiving space 45 extending along the length of the nail groove 43 and extending upwardly from the nail groove 43 to the top end 415 of the housing 41 and having a front side, and a sliding passage 46 disposed sidewisely at the front side of the plate receiving space 45 above the nail groove 43 and extending along the length of the plate receiving space 450

The cartridge housing 41 includes upper and lower partitions 47, 48 that have top and bottom ends, that are disposed between the plate receiving space 45 and the sliding passage 46, that extend along the length of the sliding passage 46, and that are vertically registered with each other to define therebetween a gap 49 so as to permit the sliding passage 46 to be in spatial communication with the plate receiving space 45. The cartridge housing 41 is formed with an upper recess 471 and a lower recess 481 which are vertically registered with each other, which extend from the top ends of the upper and lower partitions 47, 48 through the bottom ends of the upper and lower partitions 47, 48, and which are disposed adjacent to the right open end 412 of the housing 41.

The cartridge housing 41 further has upper recess confining walls 472 that respectively define the upper recesses 471.

The cartridge housing 41 further defines therein an elongated slot 42 extending from the left open end 411 to the right open end 412 of the housing 41 at the top end 415 of the housing 41, disposed over and in spatial communication with the plate receiving space 45, and having a width greater than that of the plate receiving space 45.

The guide rail 44 is fittingly received in the slot 42, and has opposite spaced apart front and rear bottom walls 443, 444 that define a bottom slit 441 therebetween. The bottom slit 441 extends along the length of the guide rail 44 and is in spatial communication with the plate receiving space 45. The front bottom wall 443 of the guide rail 44 is formed with a pair of spaced apart retaining recesses 442 that are vertically and respectively registered with the upper recesses 471 and that are defined by retaining recess confining walls 445.

The cartridge housing 41 further includes a top wall 401 confining a top side of the slot 42, a rear wall 402 extending between the left and right open ends 411, 412 of the housing 41 and extending downwardly from the top wall 401 at one side of the bottom slit 441 to the bottom end 416 of the housing 41, a lower front wall 403 parallel to the rear wall 402 and disposed at an opposite side of the bottom slit 441 underneath the lower partition 48, a U-shaped bottom wall 404 interconnecting and cooperating with the rear wall 402 and the lower front wall 403 to define thereamong the nail groove 43, an inclined middle front wall 405 extending upwardly and frontwardly from a top end of the lower front wall 403, a first transverse wall 406 transverse to and extending frontwardly from the bottom end of the lower partition 48 to connect with the inclined middle front wall 405, a second transverse wall 407 transverse to and extending frontwardly from the top end of the upper partition 47 to connect with the top wall 401, and an upper front wall 408 interconnecting the first and second transverse walls 406, 407 and cooperating with the upper and lower partitions 47, 48 and the first and second transverse walls 406, 407 to define thereamong the sliding passage 46. The upper and lower partitions 47, 48 and the inclined middle front wall 405 cooperate with the rear wall 402 to define thereamong the plate receiving space 45. The upper front wall 408 is formed with an elongated front opening 409 extending from the left open end 411 along the length thereof and communicating with the sliding passage 46.

The planar nail pushing plate 60 is disposed and movable in the longitudinal direction (X) in the plate receiving space 45, spans the upper and lower partitions 47, 48, and has an upper portion 601 received in the plate receiving space 45, a pair of spaced apart tabs 64 extending upwardly from the upper portion 601 through the bottom slit 441 and into the guide rail 44, and a lower portion 602 extending downwardly from the upper portion 601 into the nail groove 43 so as to push the nails 30 in the nail groove 43 to move from the right open end 412 to the left open end 411 of the housing 41. A post 61 is transverse to and projects frontwardly from a front face of the nail pushing plate 60 to the front opening 409 in the upper front wall 408 of the housing 41. The nail pushing plate 60 has a thickness that is less than those of the upper and lower partitions 47, 48. The second urging member 63 is sleeved on the post 61.

The first urging member 50 is disposed in the sliding passage 46, and has one end that is secured to the housing 41 adjacent to the left open end 411 of the housing 41, and an opposite end that is movable in the longitudinal direction (X) in the sliding passage 46.

The sliding seat 72 is disposed slidably in the sliding passage 46, and has a first through-hole 721 that receives the post 61 and the second urging member 63, and a stud 723 projecting from a front face of the sliding seat 72 and engaging the opposite end of the first urging member 50 so as to connect the first urging member 50 to the nail pushing plate 60 and to permit the nail pushing plate 60 to be urged by the first urging member 50 to move from the right open end 412 to the left open end 411 of the housing 41.

Figure 8:
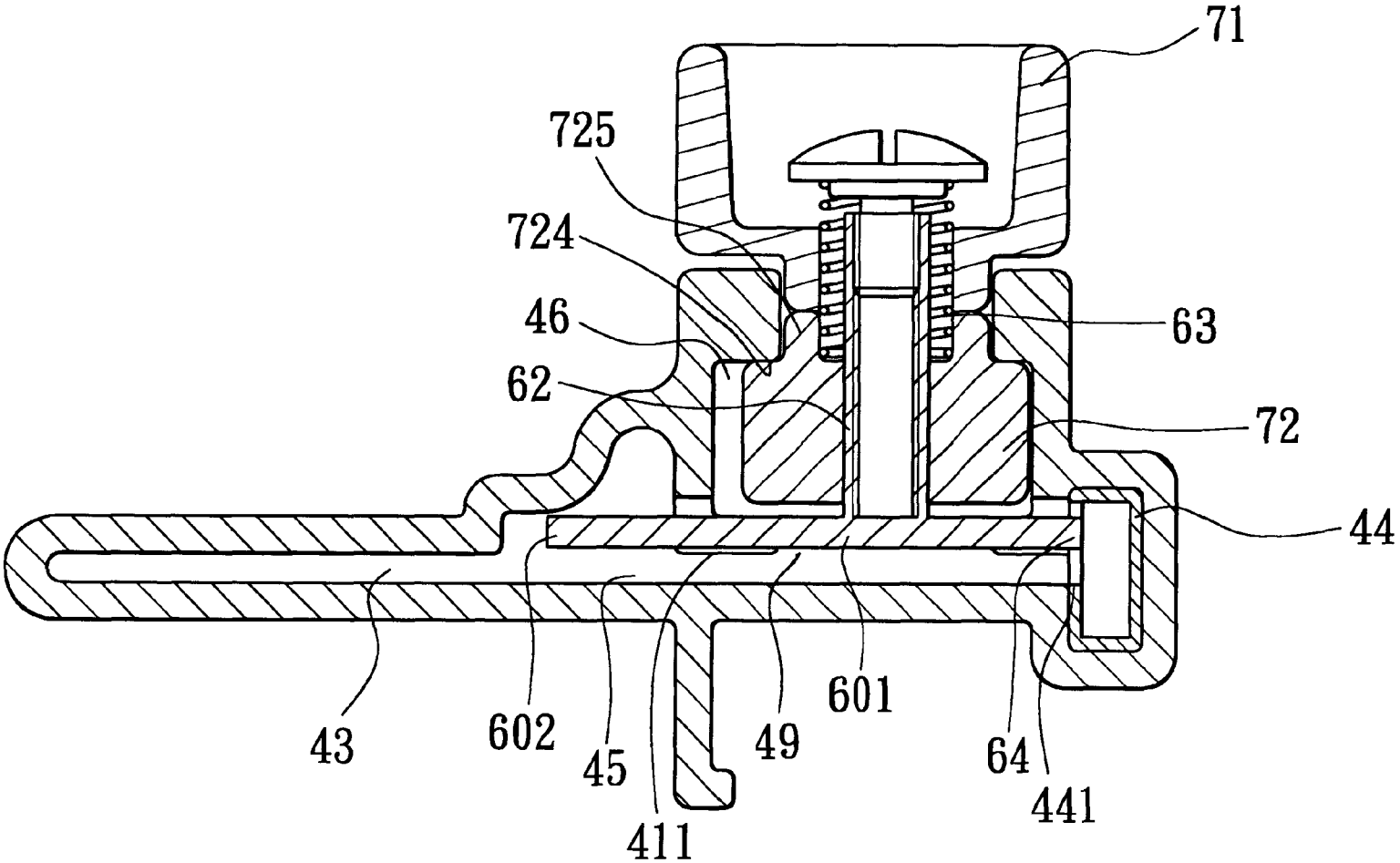
FIG. 8 is a cross-sectional side view of the nail cartridge of FIG. 2, with the upper portion of the nail pushing plate of the nail cartridge disposed in the upper and lower recesses.

The knob 71 is disposed at and is slidable along the length of the front opening 409 in the upper front wall 408 of the housing 41, is secured to the sliding seat 72 via screw means 73 for moving the nail pushing plate 60 in the plate receiving space 45, and is formed with a second through-hole 711 that is registered with the first through-hole 721 and that receives the post 61 and the second urging member 63. A headed screw 74 extends through the second through-hole 711 in the knob 71, and threadedly engages the post 61 such that two opposing ends of the second urging member 63 abut respectively against the sliding seat 72 and the headed screw 74 so as to permit the second urging member 63 to urge the nail pushing plate 60 in a manner that when the nail pushing plate 60 is moved in the plate receiving space 46 to a first position where the tabs 64 and the lower portion 602 of the nail pushing plate 60 are laterally and respectively registered with the upper and lower recesses 471, 481, the nail pushing plate 60 will be moved frontwardly by the second urging member 63 to a second position (see FIGS. 7 and 8) where the upper portion 601 of the nail pushing plate 60 is received in the gap 49, where the tabs 64 of the nail pushing plate 60 are respectively received in the retaining recesses 442, and where the lower portion 602 of the nail pushing plate 60 extends through the lower recess 481 and is sidewisely offset from the nail groove 34 so as to permit the nail groove 34 to be cleared of the nail pushing plate 60 and to thereby permit loading of the nails 30 into the nail groove 34 from the right open end 412 of the housing 41 without requiring detachment of the nail pushing plate 60 from the cartridge housing 41. The nail pushing plate 60 can be retained at the second position by engagement of the upper recess confining walls 472 and the upper portion 601 of the nail pushing plate 60, and by engagement of the retaining recess confining walls 445 and the tabs 64 of the nail pushing plate 60.

Since the nail pushing plate 60 is movable frontwardly, the sliding seat 72 should also be rovable frontwardly in the sliding passage 46 together with the nail pushing plate 60. To achieve such movement, the sliding seat 72 is formed with a shoulder 724 received in the sliding passage 46 and facing an inner wall of the upper front wall 408 of the housing 41, and has a flange 725 reduced and projecting from the shoulder 724 into the front opening 409 in the upper front wall 408 of the housing 41. The shoulder 724 of the sliding seat 72 is spaced apart from the inner face of the upper front wall 408 by a clearance 726 (see FIGS. 5 and 6) that has a width greater than the thickness of the nail pushing plate 60 so as to permit the nail pushing plate 60 to move frontwardly to the aforesaid second position.

It is noted that the upper and lower recesses 471, 481 can respectively extend from the upper and lower partitions 47, 48 to the first and second transverse walls 407, 408 so as to permit the upper portion 601 of the nail pushing plate 60 to be received in the sliding passage 46 instead of being received in the gap 49 when the nail pushing plate 60 is at the second position.

With the design that the nail pushing plate 60 is able to be moved in a transverse direction relative to the aforesaid longitudinal direction (X) in the cartridge housing 41 to a position, where the nail pushing plate 60 is sidewisely offset from the nail groove 43, the drawbacks as encountered in the prior art can be eliminated.

With the invention thus explained, it is apparent that various modifications can be made without departing from the spirit of the present invention. It is therefore intended that the invention be limited only as recited in the appended claims.

I claim:

1. A nail cartridge for a pneumatic nail driving device, comprising:

an elongated cartridge housing that extends in a longitudinal direction, that has top and bottom ends, front and rear sides, and left and right open ends and that defines therein a nail groove extending in said longitudinal direction from said left open end to said right open end and extending upwardly from said bottom end of said housing and adapted to receive nails which are to be aligned in said longitudinal direction, a plate receiving space extending along the length of said nail groove and extending upwardly from said nail groove to said top end of said housing and having a front side, and a sliding passage disposed sidewisely at said front side of said plate receiving space and extending along the length of said plate receiving space, said housing including upper and lower partitions that have top and bottom ends, that are disposed between said plate receiving space and said sliding passage, that extend along the length of said sliding passage, and that are vertically registered with each other to define therebetween a gap so as to permit said sliding passage to be in spatial communication with said plate receiving space, said housing being formed with upper and lower recesses which are vertically registered with each other, which extend from said top ends of said upper and lower partitions through said bottom ends of said upper and lower partitions, and which are disposed adjacent to said right open end of said housing;

a nail pushing plate disposed and movable in said longitudinal direction in said plate receiving space, spanning said upper and lower partitions, and having an upper portion received in said plate receiving space and a lower portion extending downwardly from said upper portion into said nail groove, said nail pushing plate being adapted to push the nails in said nail groove to move from said right open end to said left open end;

a first urging member disposed in said sliding passage and having one end that is secured to said housing adjacent to said left open end of said housing, and an opposite end that is movable in said longitudinal direction in said sliding passage and that is connected to said nail pushing plate so as to urge said nail pushing plate to move from said right open end to said left open end of said housing; and a second urging member for urging said nail pushing plate in a manner that when said nail pushing plate is moved in said plate receiving space to a first position where said upper and lower portions of said nail pushing plate are laterally and respectively registered with said upper and lower recesses, said nail pushing plate will be moved frontwardly by said second urging member to a second position where said upper portion of said nail pushing plate is selectively received in one of said sliding passage and said gap and is retained therein, and where said lower portion of said nail pushing plate is sidewisely offset from said nail groove so as to permit said nail groove to be cleared of said nail pushing plate and to thereby permit loading of the nails into said nail groove from said right open end of said housing.

2. The nail cartridge of claim 1, wherein said nail pushing plate is planar and has a thickness that is less than those of said upper and lower partitions, said upper portion of said nail pushing plate being retained in said gap when said nail pushing plate is moved to said second position, said housing having an upper recess confining wall that defines said upper recess and that engages said upper portion of said nail pushing plate so as to permit said nail pushing plate to be retained at said second position.

3. The nail cartridge of claim 2, wherein said housing further defines an elongated slot extending from said left open end to said right open end of said housing at said top end of said housing, disposed over and in spatial communication with said plate receiving space, and having a width greater than that of said plate receiving space, said nail cartridge further comprising an elongated hollow guide rail fittingly received in said slot and having a bottom slit that extends along the length of said guide rail and that is in spatially communication with said plate receiving space, said nail pushing plate further having a tab extending upwardly from said upper portion of said nail pushing plate through said bottom slit, said guide rail having opposite spaced apart front and rear bottom walls that define said bottom slit, said front bottom wall being formed with a retaining recess that is vertically registered with said upper recess so as to receive said tab of said nail pushing plate when said nail pushing plate is at said second position.

4. The nail cartridge of claim 3, wherein said housing further includes a top wall confining a top side of said slot, a rear wall extending between said left and right open ends of said housing and extending downwardly from said top wall at one side of said bottom slit to said bottom end of said housing, a lower front wall parallel to said rear wall and disposed at an opposite side of said bottom slit underneath said lower partition, a U-shaped bottom wall interconnecting and cooperating with said rear wall and said lower front wall to define thereamong said nail groove, an inclined middle front wall extending upwardly and frontwardly from a top end of said lower front wall, a first transverse wall transverse to and extending frontwardly from said bottom end of said lower partition to connect with said inclined middle front wall, a second transverse wall transverse to and extending frontwardly from said top end of said upper partition to connect with said top wall, and an upper front wall interconnecting said first and second transverse walls and cooperating with said upper and lower partitions and said first and second transverse walls to define thereamong said sliding passage, said upper and lower partitions and said inclined middle front wall cooperating with said rear wall to define thereamong said plate receiving space, said upper and lower recesses respectively extending from said upper and lower partitions to said first and second transverse walls.

5. The nail cartridge of claim 4, wherein said upper front wall is formed with an elongated front opening extending from said left open end of said housing along the length thereof and communicating with said sliding passage, said nail cartridge further comprising a sliding seat disposed slidably in said sliding passage and interconnecting said nail pushing plate and said first urging member, and a knob disposed at and slidable along the length of said front opening and secured to said sliding seat so as to move said nail pushing plate and said first urging member from said left open end to said right open end of said housing.

6. The nail cartridge of claim 5, wherein said nail pushing plate has a front face, and is provided with a post transverse to and projecting frontwardly from said front face to said front opening, said first urging member being a spiral spring, said second urging member being a coil spring that is sleeved on said post, said sliding seat having a through-hole that receives said post and said second urging member, and a stud that engages said first urging member so as to connect said nail pushing plate to said first urging member, said nail cartridge further comprising a headed screw extending through said knob and threadedly engaging said post, said second urging member having two opposing ends respectively abutting against said sliding seat and said headed screw so as to urge said nail pushing plate to move frontwardly.

* * * * *